US009217263B1

(12) United States Patent
Lee

(10) Patent No.: US 9,217,263 B1
(45) Date of Patent: Dec. 22, 2015

(54) DOUBLE-OPENING LOCK ASSEMBLY

(71) Applicant: GETAC TECHNOLOGY CORPORATION, Hsinchu County (TW)

(72) Inventor: Gwo-Shiang Lee, Hsinchu County (TW)

(73) Assignee: Getac Technology Corporation, Hsinchu County (TW)

( * ) Notice: Subject to any disclaimer, the term of this patent is extended or adjusted under 35 U.S.C. 154(b) by 0 days.

(21) Appl. No.: 14/662,912

(22) Filed: Mar. 19, 2015

(51) Int. Cl.
*E05B 47/00* (2006.01)

(52) U.S. Cl.
CPC ..... *E05B 47/0001* (2013.01); *E05B 47/0012* (2013.01); *E05B 2047/002* (2013.01); *Y10T 70/7062* (2013.01)

(58) Field of Classification Search
CPC ..... Y10T 70/7062; Y10T 70/7107; Y10T 70/7102; Y10T 70/5031; Y10T 70/7028; E05B 47/0012; E05B 2047/0016; E05B 47/0603; E05B 47/068; E05B 47/0673; E05B 2047/0024; E05B 2047/0073; E05B 2047/0094
USPC ..... 70/279.1, 63, 58, 277, 465, 150
See application file for complete search history.

(56) References Cited

U.S. PATENT DOCUMENTS

| | | | | | |
|---|---|---|---|---|---|
| 2,271,966 | A * | 2/1942 | Baribault | 292/153 |
| 2,637,196 | A * | 5/1953 | Seaver et al. | 70/264 |
| 2,667,778 | A * | 2/1954 | Schmitt | 70/150 |
| 3,200,623 | A * | 8/1965 | Peters | 70/279.1 |
| 3,304,755 | A * | 2/1967 | Johnstone | 70/279.1 |
| 3,656,327 | A * | 4/1972 | Ford et al. | 70/133 |
| 4,135,377 | A * | 1/1979 | Kleefeldt et al. | 70/264 |
| 4,433,355 | A * | 2/1984 | Chew et al. | 361/172 |
| 4,651,544 | A * | 3/1987 | Hungerford | 70/63 |
| 4,895,008 | A * | 1/1990 | Blake | 70/86 |
| 5,307,656 | A * | 5/1994 | Gartner et al. | 70/277 |
| 5,575,515 | A * | 11/1996 | Iwamoto et al. | 292/341.17 |
| 5,794,466 | A * | 8/1998 | Hungerford et al. | 70/63 |
| 5,826,715 | A * | 10/1998 | Thompson | 206/261 |
| 6,260,300 | B1 * | 7/2001 | Klebes et al. | 42/70.11 |
| 6,406,075 | B1 * | 6/2002 | Rice et al. | 292/336.3 |
| 6,629,441 | B2 * | 10/2003 | Lavergne | 70/278.3 |
| 6,843,081 | B1 * | 1/2005 | Painter | 70/63 |
| 7,128,350 | B2 * | 10/2006 | Eckerdt | 292/341.16 |
| 2002/0183106 | A1 * | 12/2002 | Cole | 463/16 |
| 2005/0183480 | A1 * | 8/2005 | Hingston et al. | 70/279.1 |
| 2007/0013478 | A1 * | 1/2007 | Crigger et al. | 340/5.53 |

(Continued)

FOREIGN PATENT DOCUMENTS

| | | |
|---|---|---|
| EP | 2 159 316 A1 | 3/2010 |
| GB | 2 425 327 A | 10/2006 |

*Primary Examiner* — Suzanne Barrett

(57) ABSTRACT

Disclosed is a double-opening lock assembly. The double-opening lock assembly comprises a door plate member, a mechanical lock, and an electrically controlled member. The door plate member comprises a door plate and a block member. The mechanical lock comprises a block plate having a first part and a second part. When the mechanical lock is opened, the block plate leaves the block member. The electrically controlled member comprises a driving part and an extending part. The driving part drives the extending part to a first position or a second position. When the extending part is positioned at the first position, the second part is limited by the block member and the extending part such that the door plate cannot be opened. When the extending part is positioned at the second position, the second part pivotally rotates and leaves the block member such that the door plate can be opened.

10 Claims, 8 Drawing Sheets

(56) References Cited

U.S. PATENT DOCUMENTS

2007/0152455 A1* 7/2007 Ko et al. ..... 292/201
2008/0100079 A1* 5/2008 Herrera et al. ..... 296/37.1
2008/0105012 A1* 5/2008 Poppell ..... 70/279.1
2009/0282879 A1* 11/2009 Marcelle et al. ..... 70/277
2010/0277264 A1* 11/2010 Charnley et al. ..... 335/234
2011/0146359 A1* 6/2011 Elsner et al. ..... 70/63
2011/0277516 A1* 11/2011 Kahara et al. ..... 70/58
2011/0290577 A1* 12/2011 Abidi ..... 180/281
2012/0047971 A1* 3/2012 Katagiri et al. ..... 70/58
2012/0297842 A1* 11/2012 Gartner ..... 70/278.1

* cited by examiner

DOUBLE-OPENING LOCK ASSEMBLY

BACKGROUND OF THE INVENTION

1. Field of the Invention

The invention relates to a lock assembly, and more particularly, to a mechanical and electrical double-opening lock assembly.

2. Description of the Prior Art

As digitization develops, the collection and compilation of necessary information from massive data are the most crucial subjects in the Digital Age. What also follows is the development of massive data storage devices such as conventional hard disks, disk arrays, flash drives, memory cards, cloud storage, etc. Such data storages have also become the most significant digital media at present days.

After placing the data storage devices such as portable hard disks, memory cards, etc. into hosts such as digital video recorders (DVR), servers, traffic cameras, or event data recorders, a mechanical lock opened/closed with a key is commonly configured in front of a data storage device slot of the host for data preservation considerations, so as to prevent the loss of critical images and data and to preserve important evidence. The mechanical lock is usually opened with the key only when necessary to remove the data storage device to access data. However, once the key of the mechanical lock is accidentally lost or bent and deformed, the user may not be able to open the mechanical lock to remove the data storage device to access data.

Particularly, for data storage devices for preserving evidence such as traffic cameras or event data recorders, since they usually operate by continuously saving data, previous data is overwritten after a certain time limit or after the full storage capacity is reached. To prevent previous data from being overwritten and critical data from being lost, it is thus necessary to have a backup lock-opening method for data storage device slots installed with safety locks. At present, when the key of the safety lock is lost or bent and deformed, a common method to open the lock is electrical control. Therefore, requirements for electrically controlled locks on data storage devices have also risen, so as to open the lock by electrical control when the user accidentally loses the key.

Generally speaking, electrically controlled unlocking methods are similar with conventional electrically controlled locks in apartments and buildings. By applying electric power, the lock bolt is withdrawn to open the door plate. However, in short, electrically controlled locks often are oversized and overweighed and are not suitable for common electronic products. Therefore, an unlocking method that solves the above issues is required.

SUMMARY OF THE INVENTION

The main purpose of the present invention is to provide a double-opening lock assembly mainly installed on a data storage device slot to facilitate data preservation and provide two lock-opening methods of mechanical and electrical opening.

The double-opening lock assembly comprises a door plate member, a mechanical lock, and an electrically controlled member. The door plate member comprises a door plate and a block member. The mechanical lock comprises a block plate having a first part, a second part, and a pivotal rotation device, wherein the first part and the second part are fixed to each other by the pivotal rotation device, and the second part pivotally rotates about the first part. When a key inserts into the mechanical lock, the key drives the block plate to rotate and leave the block member such that the door plate is released and opened.

The electrically controlled member comprises a driving part and an extending part, and the extending part is connected to the driving part and is at a side of the block plate. The driving part drives the extending part from a first position to a second position when electric power is applied to the electrically controlled member, and the opposite is carried out when no electric power is applied. When the extending part is positioned at the first position, the second part is limited by the block member and the extending part such that the door plate cannot be opened. When the extending part is positioned at the second position, since the second part is no longer limited by the extending part, the second part pivotally rotates about the first part by the pivotal rotation device and leaves the block member when the door plate is pulled. Thusly, the door plate member and the mechanical lock do not limit each other and are released such that the door plate is opened.

Since a plane in which the block plate rotates when opened by the key is orthogonal to a plane in which the second part pivotally rotates about the first part, they do not affect each other. Even when the key is not available, the door plate member may be opened/closed by electrical control without being affected.

The technical feature of the double-opening lock assembly of the present invention is mainly about the utilization of the design of the block plate of the mechanical lock; by pivotal connection, the second part may pivotally rotate about the first part. In addition, the electrically controlled member is configured to control the limitation of the pivotal rotation. Therefore, the effect of mechanical and electrical double-opening may be achieved to solve the shortcomings in conventional mechanical locks.

Furthermore, a first signal transceiver may be configured near the double-opening lock assembly of the present invention while a second signal transceiver may be configured on the electrically controlled member, so that a remote host may control the application of electric power to the electrically controlled member or not by wireless remote control. Data such as opening time, closing time, etc. may be received and recorded to carry out data control and avoid information-stealing issues.

By the above embodiments, the issue of conventional mechanical locks being limited by keys may be overcome by simple and convenient practices, while the size and weight are not significantly increased and the overall operation of the data storage device is not affected.

DETAILED DESCRIPTION OF THE EMBODIMENTS

Figure 1A:
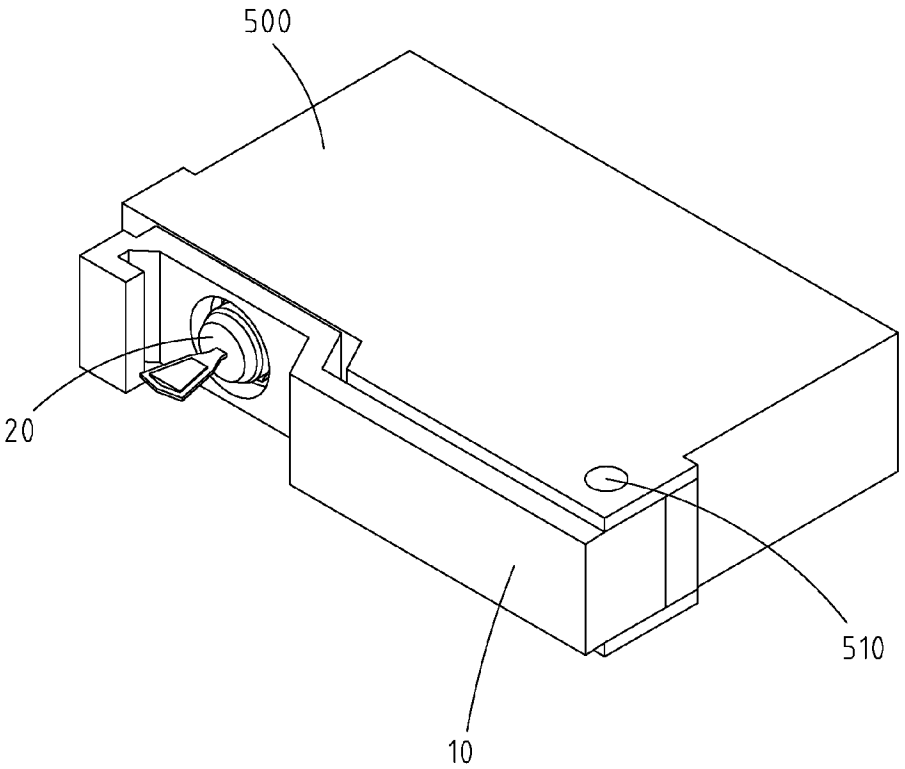
FIG. 1A and FIG. 1B are schematics of a closed status and an opened status, respectively, of a double-opening lock assembly of the invention.
Figure 1B:
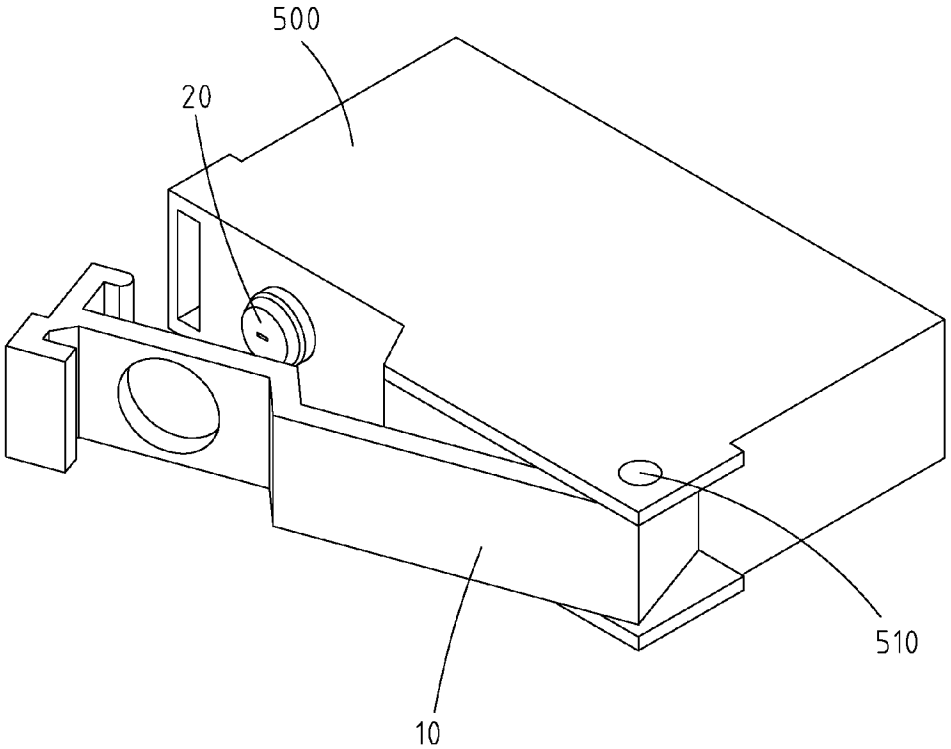

FIG. 1A and FIG. 1B show schematics of a closed status and an opened status, respectively, of a double-opening lock assembly of the present invention. The double-opening lock assembly of the present invention is mainly installed on a data storage device slot 500. A shown in FIG. 1A, the double-opening lock assembly of the present invention comprises a door plate member 10 and a mechanical lock 20, wherein the mechanical lock 20 is configured on the data storage device slot 500 and is engaged with the door plate member 10. A shown in FIG. 1B, when the door plate member 10 is opened, the door plate member 10 leaves the mechanical lock 20 and pivotally rotates about a rotation shaft 510 on the data storage device slot 500.

Figure 2:
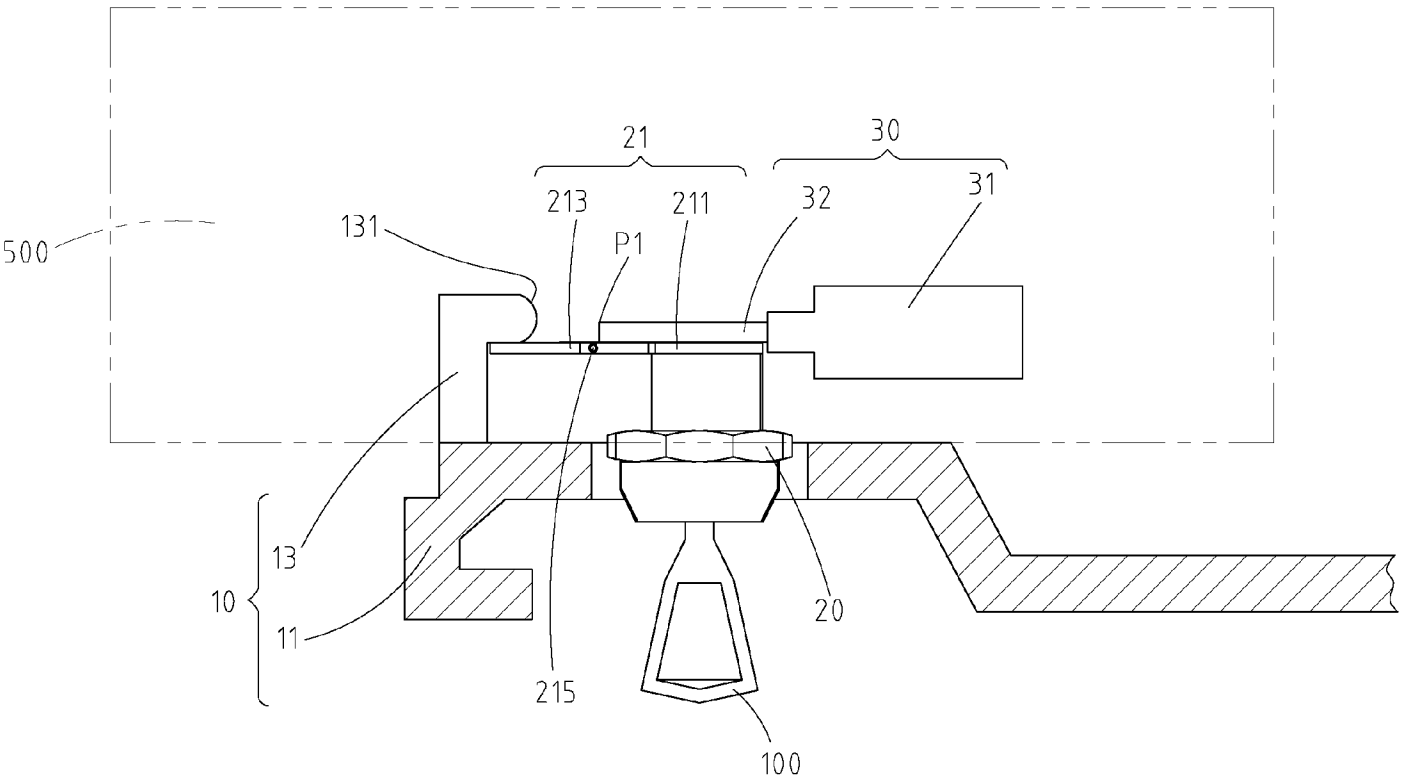
FIG. 2 is a top view of the double-opening lock assembly of the invention.

FIG. 2 shows a top view of the double-opening lock assembly of the present invention. A shown in FIG. 2, the double-opening lock assembly of the present invention comprises the door plate member 10, the mechanical lock 20, and an electrically controlled member 30. The door plate member 10 comprises a door plate 11 and a block member 13. The mechanical lock 20 is configured to engage with the door plate 11. The mechanical lock 20 may be a key lock corresponding to a key 100.

The mechanical lock 20 comprises a block plate 21 having a first part 211, a second part 213, and a pivotal rotation device 215. The first part 211 and the second part 213 are fixed to each other by the pivotal rotation device 215, so that the second part 213 may pivotally rotate about the first part 211. The pivotal rotation device 215 may be a combination of a hinge device and a torsional spring, or may be a rotational shaft. The electrically controlled member 30 comprises a driving part 31 and an extending part 32, wherein the driving part 31 drives the extending part 32 when electric power is applied to the electrically controlled member 30, and the extending part 32 is at a side of the block plate 21.

FIG. 2 shows the double-opening lock assembly at a closed status. When at this status, the extending part 32 is positioned at a first position P1, and the block plate 21 is interfered by the block member 13 and the extending part 32 so that it cannot be moved. Therefore, the door plate member 10 and the mechanical lock 20 are engaged with each other.

Figure 3:
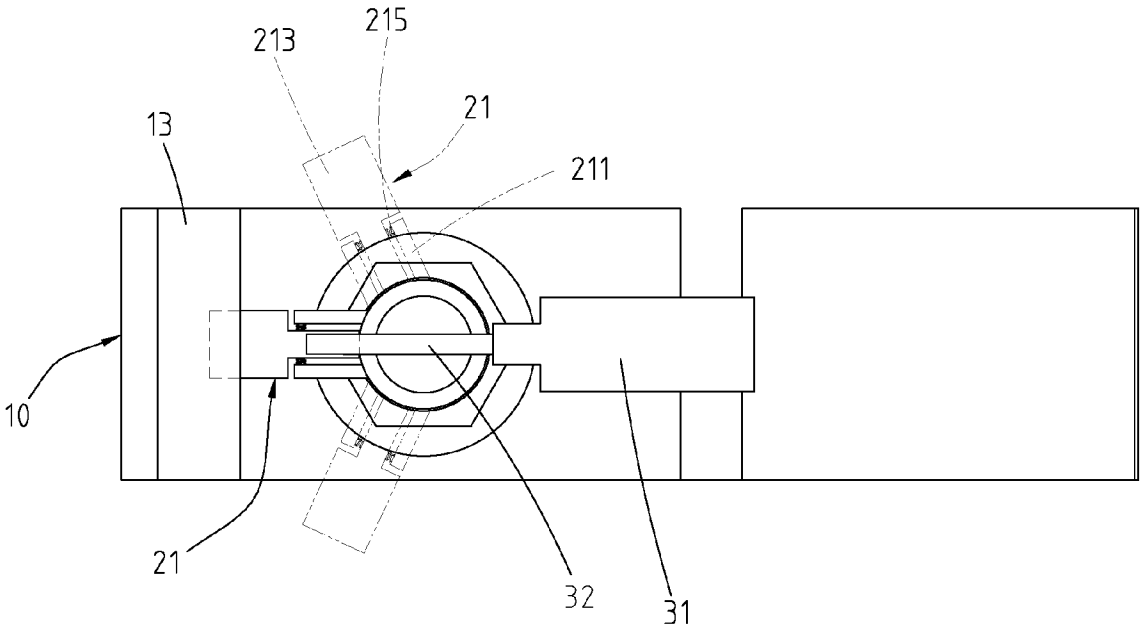
FIG. 3 is a rear view of a mechanical-opening status of the double-opening lock assembly of the invention.

FIG. 3 shows a rear view of a mechanical-opening status of the double-opening lock assembly of the present invention; FIG. 2 should also be referred to. Viewing from the rear of the door plate 11, when the key 100 inserts into the mechanical lock 20 and rotates, the key 100 drives the block plate 21 of the mechanical lock 20 to rotate. When the key completely opens the mechanical lock 20, the block plate 21 is driven to rotate and leave a interference range of the block member 13 such that the door plate member 10 is no longer limited by the block plate 21 and is released from the mechanical lock 20, as shown in FIG. 1B, and the door plate member 10 may thus be opened.

Figure 4:
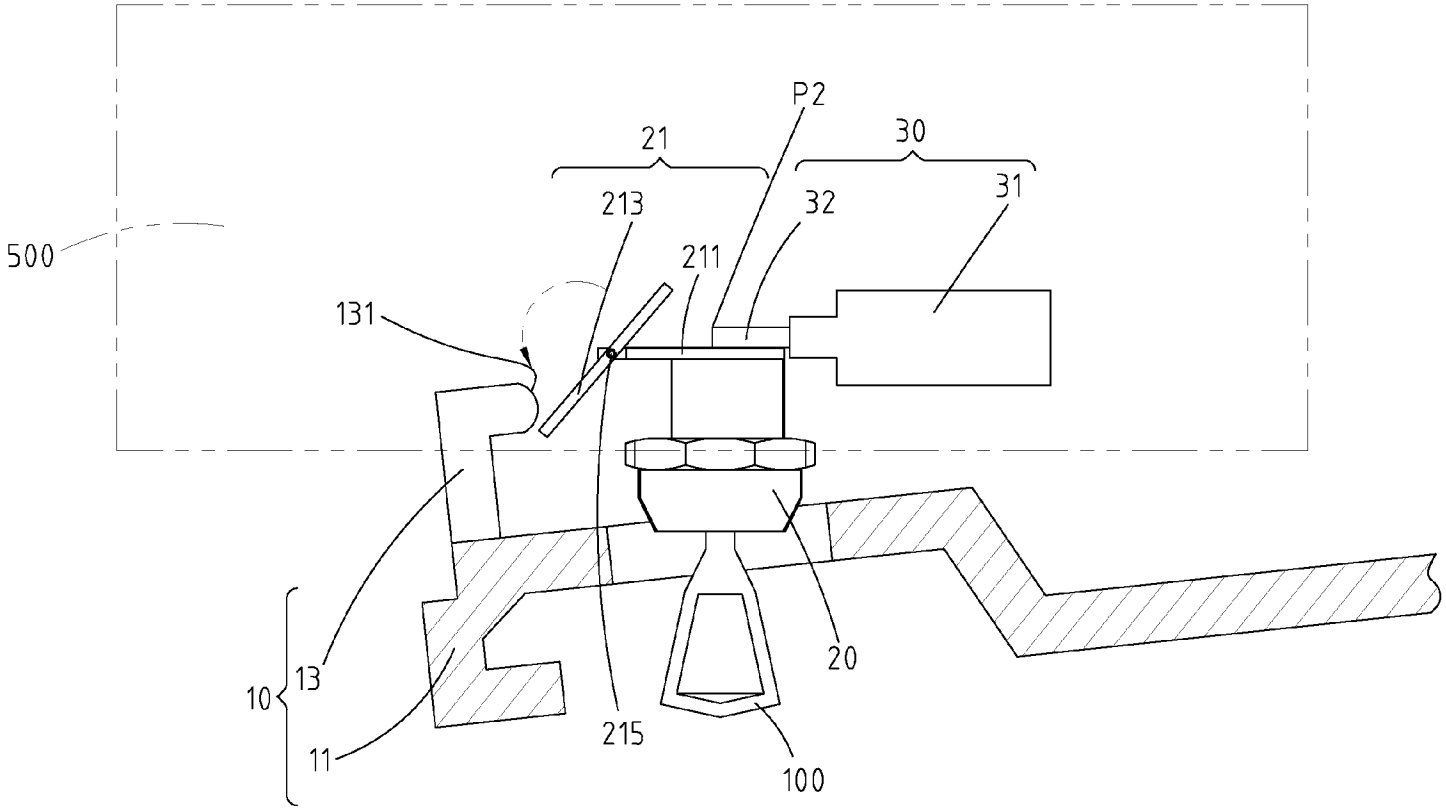
FIG. 4 is a top view of an electrical-opening status of the double-opening lock assembly of the present invention.

FIG. 4 shows a top view of an electrical-opening status of the double-opening lock assembly of the present invention. As shown in FIG. 4, the door plate member 10 may be opened by electrically controlled opening when the key 100 is not available. The electrical-opening status may be implemented by remote control, remote power control, etc. For example, again referring to FIG. 2, when no electric power is applied to the electrically controlled member 30, the extending part 32 is positioned at the first position P1 so that the second part 213 is interfered by the extending part 32 and may not rotate. A shown in FIG. 4, when electric power is applied to the electrically controlled member 30, the driving part 31 drives the extending part 32 to the second position P2 so that the second part 213 is no longer limited and interfered by the extending part 32 and may thus rotate. When the door plate 11 is pulled, the block member 13 originally obstructing the second part 213 drives the second part 213 so that the second part 213 pivotally rotates under force, and further leaves the block member 13 completely such that the door plate member 10 is no longer engaged with the mechanical lock 20 and is released from the mechanical lock 20 to be opened.

A moving direction in which the extending part 32 moves from the first position P1 to the second position P2 is parallel with an extending direction of the block member 13; however, this is only an example and the invention is not limited thereto. The driving part 31 may be a solenoid device, but the invention is not limited thereto.

Figure 5:
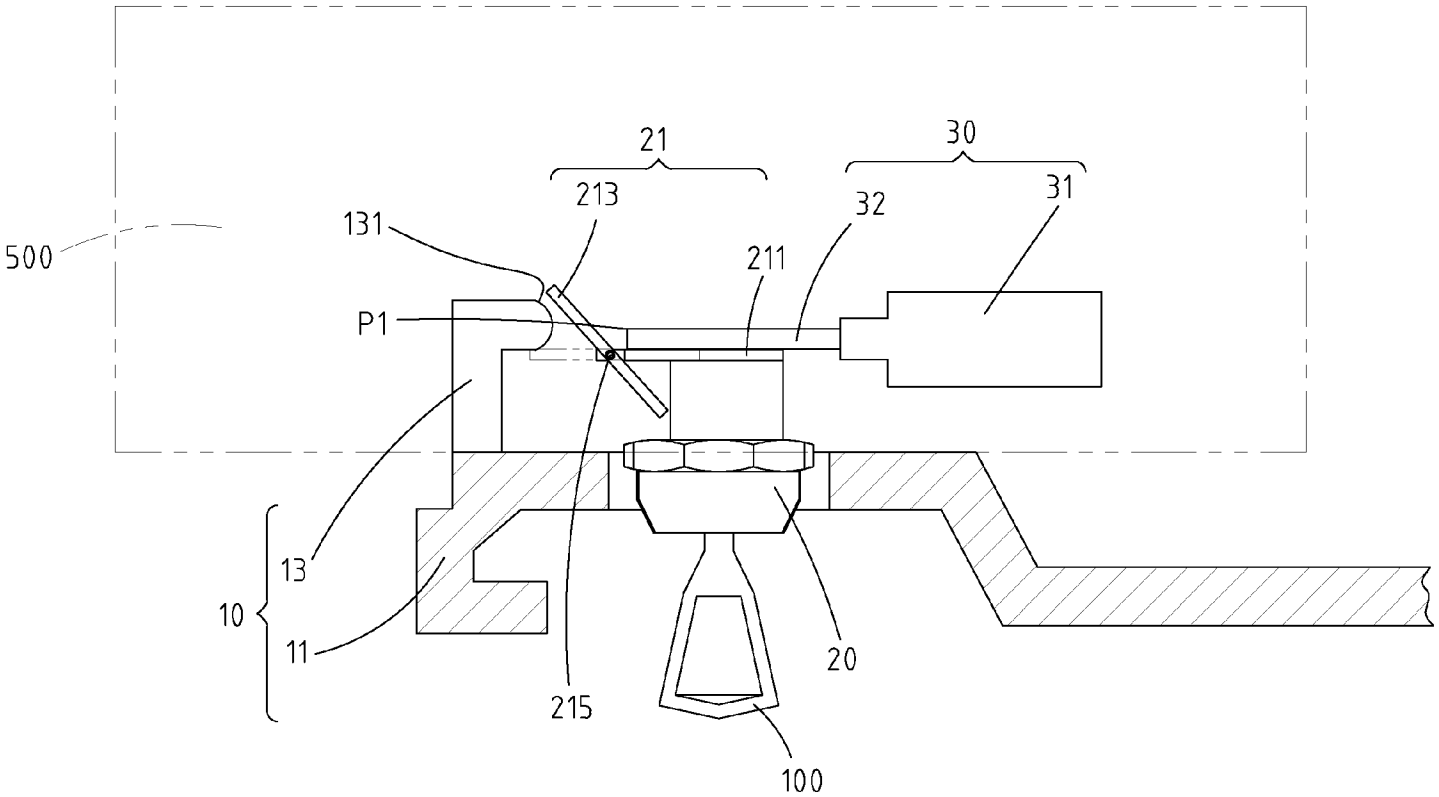
FIG. 5 is a top view of a closed status of the double-opening lock assembly of the invention.
Figure 6:
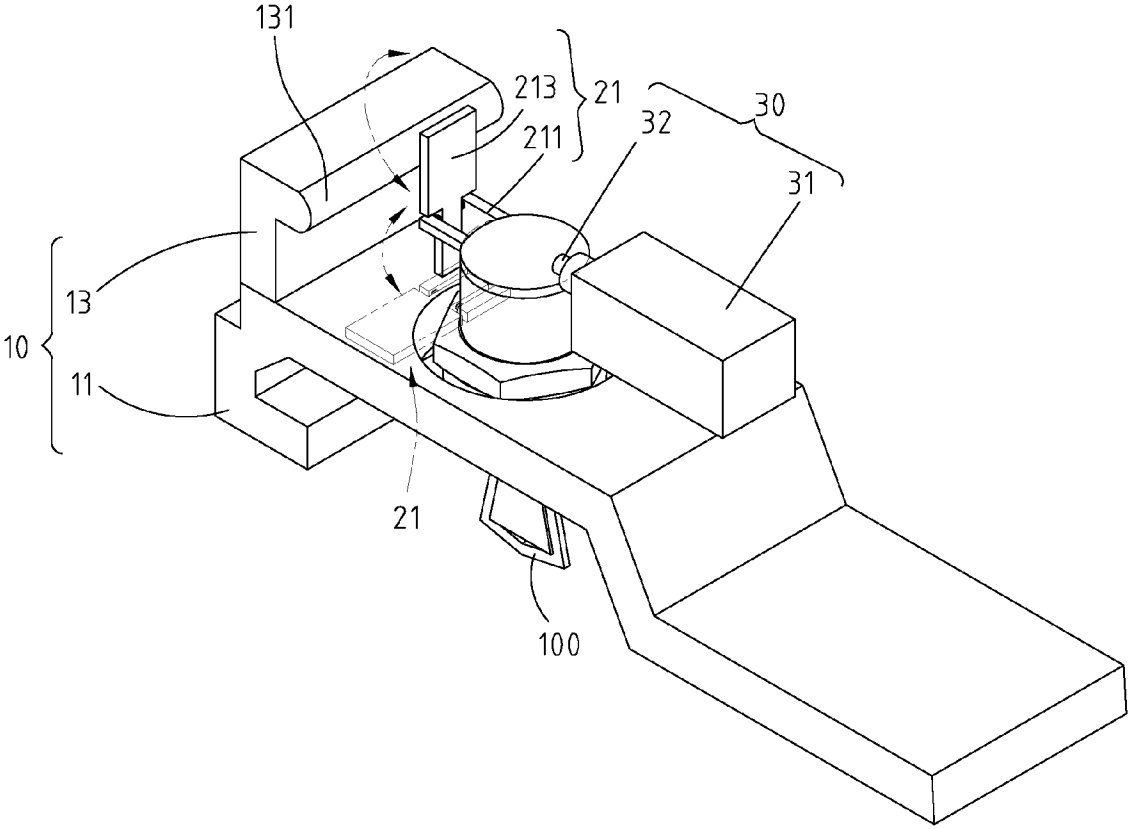
FIG. 6 is a detailed perspective view of a mechanical lock of the invention.

FIG. 5 shows a top view of a closed status of the double-opening lock assembly of the present invention. A shown in FIG. 5, when electric power is no longer applied to the electrically controlled member, the driving part 31 drives the extending part 32 back to the first position P1. When the door plate member 10 is closed, the block member 13 obstructs the second part 213, so that the second part 213 pivotally rotates counterclockwise to rotate to a position behind the block member 13 as shown in the solid-line position in FIG. 5. Subsequently, the second part 213 returns to a position in front of the block member 13 along a curved surface 131 of the block member 13 by torsional force of the pivotal rotation device 215 itself, as shown in the dashed-line position in FIG. 5. Finally, after the door plate member 10 is closed, the status in FIG. 2 is returned to. FIG. 6 shows a detailed perspective view of the mechanical lock 20 of the present invention. A shown in FIG. 6, it should be noted that, when the mechanical lock 20 is opened, a plane in which the block plate 21 rotates is orthogonal to a plane in which the second part 213 pivotally rotates; therefore, even when the key 100 is not available, the door plate member 10 may be opened/closed by electrical control without being affected.

Figure 7:
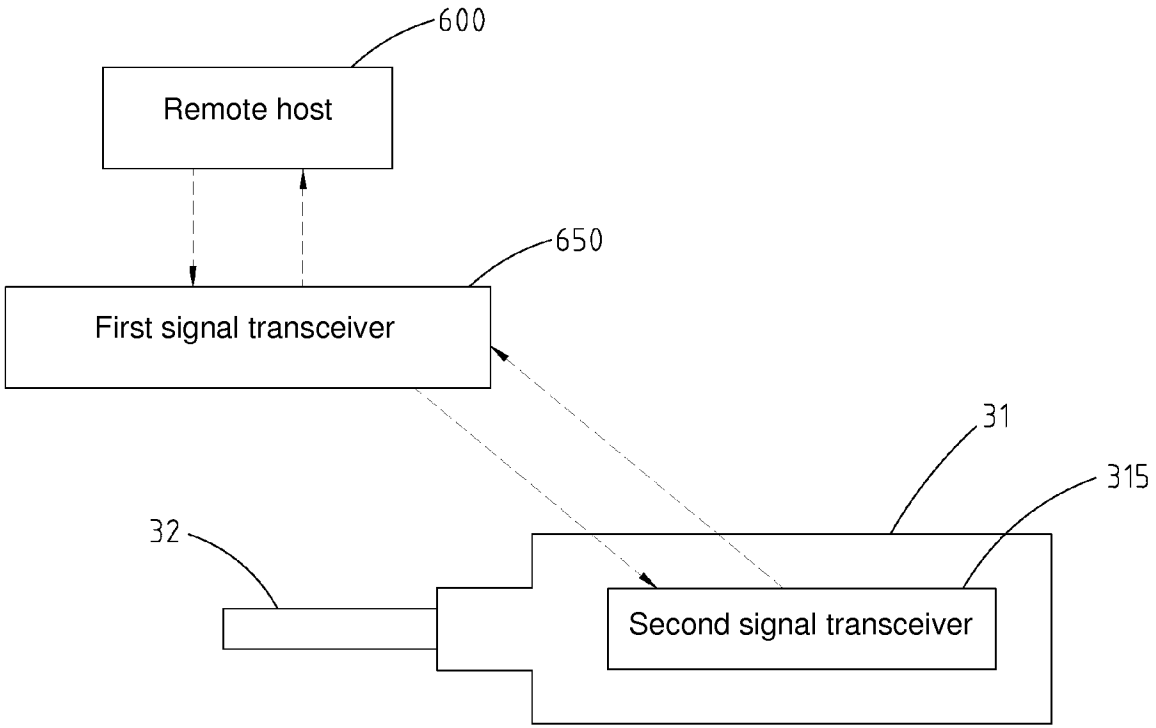
FIG. 7 is a schematic of the double-opening lock assembly and a remote connection unit of the invention.

FIG. 7 shows a schematic of the double-opening lock assembly and a remote connection unit of the present invention. A shown in FIG. 7, the double-opening lock assembly of the present invention may carry out wireless communication with a remote host 600. A first signal transceiver 650 is configured near the double-opening lock assembly of the present invention, and the driving part 31 of the electrically controlled member 30 of the invention comprises a second signal transceiver 315. When the remote host 600 receives an opening request, a notice signal is transmitted to the first signal transceiver 650, and the first signal transceiver 650 transmits a driving signal to the second signal transceiver 315 to drive the driving part 31. For example, by applying a working voltage so that the driving part 31 drives the extending part 32.

When the door plate member 10 is closed, the second signal transceiver 315 transmits a response signal to the first signal transceiver 650, and the first signal transceiver 650 transmits the response signal to the remote host 600. Thusly, the remote host 600 may record the opening and closing time of the door plate member 10. Furthermore, related information of the requester may also be recorded to ensure data security.

The double-opening lock assembly of the present invention includes two lock-opening methods of mechanical and electrical opening. The main technical feature is the utilization of the two-stage design of the block plate and the support from the electrically controlled member. In addition to opening by the original rotation of the mechanical lock, the door plate may be opened by the pivotal rotation of the second part of the block plate after electric power is applied to the electrically controlled member and the door plate is pulled. The double-opening lock assembly of the present invention has a compact overall size and does not affect the operation of common data storage devices. Moreover, by the connection between the electrically controlled member and the remote host, the opening information may be recorded to ensure data security.

What is claimed is:

1. A double-opening lock assembly, comprising:

a door plate member, comprising a door plate and a block member;

a mechanical lock, comprising a block plate having a first part and a second part, wherein the second part is pivotally rotatable relative to the first part, and wherein the block plate rotates and leaves the block member when the mechanical lock is in a open position; and an electrically controlled member, comprising a driving part and an extending part, wherein the extending part is connected to the driving part and is disposed at a side of the block plate, wherein the driving part is controlled by electric power to drive the extending part to a first position or a second position, wherein, when the mechanical lock is in a closed position and the extending part is positioned at the first position, rotation of the second part is limited by the block member and the extending part such that the door plate cannot be opened, and wherein when the mechanical lock is in a closed position and the extending part is positioned at the second position, the second part is pivotally rotatable relative to the first part such that the door plate is opened when the door plate is pulled, wherein a plane in which the block plate rotates is orthogonal to a plane in which the second part pivotally rotates.

2. The double-opening lock assembly as claimed in claim 1, wherein the driving part is a solenoid device.

3. The double-opening lock assembly as claimed in claim 1, wherein the extending part is positioned at the first position when no electric power is applied to the electrically controlled member, and the driving part drives the extending part from the first position to the second position when electric power is applied to the electrically controlled member.

4. The double-opening lock assembly as claimed in claim 1, wherein the driving part comprises a signal transceiver to receive external signals to drive the driving part to further drive the extending part.

5. The double-opening lock assembly as claimed in claim 1, wherein the first part is connected with the second part by at least one pivotal rotation device.

6. The double-opening lock assembly as claimed in claim 1, wherein the mechanical lock is a key lock corresponding to a key.

7. The double-opening lock assembly as claimed in claim 6, wherein the key drives the block plate to rotate.

8. The double-opening lock assembly as claimed in claim 1, wherein the block member has a curved surface.

9. The double-opening lock assembly as claimed in claim 1, wherein the mechanical lock is fixed on the door plate.

10. The double-opening lock assembly as claimed in claim 1, wherein a moving direction in which the extending part moves from the first position to the second position is parallel with an extending direction of the block member.

* * * * *